US011732435B2

(12) United States Patent
Jamilosa

(10) Patent No.: US 11,732,435 B2
(45) Date of Patent: Aug. 22, 2023

(54) LATCHING SYSTEM FOR DIPPER

(71) Applicant: Caterpillar Global Mining LLC, Tucson, AZ (US)

(72) Inventor: James G. Jamilosa, Waipahu, HI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 242 days.

(21) Appl. No.: 17/173,241

(22) Filed: Feb. 11, 2021

(65) Prior Publication Data

US 2022/0251800 A1 Aug. 11, 2022

(51) Int. Cl.
*E02F 3/36* (2006.01)
*E02F 3/14* (2006.01)
*E02F 3/407* (2006.01)

(52) U.S. Cl.
CPC ..... *E02F 3/3609* (2013.01); *E02F 3/143* (2013.01); *E02F 3/146* (2013.01); *E02F 3/4075* (2013.01)

(58) Field of Classification Search
CPC ..... E02F 3/143; E02F 3/146; E02F 3/3609; E02F 3/4075
See application file for complete search history.

(56) References Cited

U.S. PATENT DOCUMENTS 1,338,219 A * 4/1920 Dutcher ..... B05B 11/00 292/183
1,470,332 A * 10/1923 Schulte ..... E02F 3/4075 414/726
1,478,301 A * 12/1923 Shea ..... E02F 3/4075 37/444
1,637,689 A * 8/1927 Endersby ..... E02F 3/4075 37/444
1,660,598 A * 2/1928 Crane ..... E02F 3/4075 292/145
1,725,858 A * 8/1929 Esters ..... E02F 3/4075 292/96
2,335,352 A * 11/1943 Murtaugh ..... E02F 3/4075 16/86 A (Continued)

FOREIGN PATENT DOCUMENTS

WO 2020000012 1/2020

OTHER PUBLICATIONS

Written Opinion and International Search Report for Int'l. Patent Appln. No. PCT/US2022/015600, dated May 25, 2022 (10 pgs).

*Primary Examiner* — Saul Rodriguez
*Assistant Examiner* — Brendan P Tighe

(57) ABSTRACT

A latching system associated with a dipper door of a dipper includes a latch bar that engages with a body of the dipper. The latch bar defines a longitudinal axis. The latch bar includes a housing, one or more shims, and a wear member removably coupled to the housing. The wear member defines a wear surface and a wear axis extending parallel to the wear surface. An angle defined between the wear axis and the longitudinal axis is less than 45 degrees. The latching system also includes an arm member pivotally coupled to the dipper door such that the arm member is pivotable along a first pivot plane. The arm member contacts a portion of the latch bar for moving the latch bar along the longitudinal axis. The latching system includes a guide assembly having a guide pulley and an actuation member that causes pivoting of the arm member.

20 Claims, 6 Drawing Sheets

(56) References Cited

U.S. PATENT DOCUMENTS

| | | | | |
|---|---|---|---|---|
| 2,376,597 | A * | 5/1945 | Jones | E02F 3/4075 292/141 |
| 2,544,682 | A * | 3/1951 | Hilgeman | E02F 3/4075 292/210 |
| 5,469,647 | A | 11/1995 | Profio | |
| 5,815,958 | A * | 10/1998 | Olds | E02F 3/4075 37/444 |
| 9,027,267 | B2 | 5/2015 | Flores et al. | |
| 9,096,993 | B2 | 8/2015 | Gross et al. | |
| 9,890,515 | B2 * | 2/2018 | Gross | E02F 3/58 |
| 11,066,807 | B2 * | 7/2021 | Gross | E02F 3/308 |
| 2011/0146114 | A1 * | 6/2011 | Hren | E02F 3/4075 37/445 |
| 2015/0159341 | A1 * | 6/2015 | Gross | E02F 3/46 414/722 |
| 2017/0138015 | A1 | 5/2017 | Jamilosa | |

* cited by examiner

LATCHING SYSTEM FOR DIPPER

TECHNICAL FIELD

The present disclosure relates to a latching system associated with a dipper door of a dipper.

BACKGROUND

Machines, such as electric ropes or power shovels, draglines, and the like, are used to execute operations such as a digging operation for material removal, loading material, and unloading material. Such machines include a work implement, such as a dipper. A dipper typically includes a dipper door which is pivotally coupled to a dipper body. The dipper also includes a latching system that engages or disengages the dipper door with the dipper body. The material present within the dipper is released by disengaging the latching system. More particularly, as the latching system disengages, the dipper door pivots away from the dipper, thereby releasing the material from the dipper.

The latching system includes a latch bar that engages or disengages with the dipper body. Conventional latch bars include a wear member that contacts a latch keeper defined by the dipper body in an engaged position of the latch bar. During a movement of the latch bar from the engaged position to a disengaged position, a pull direction of the latch bar is parallel to a plane of contact of the wear member and the latch keeper. Thus, the wear member slides over the latch keeper as the latch bar moves from the engaged position to a disengaged position. This phenomenon creates a high stress concentration on the wear member which may reduce an operating life of the wear member, cause service overheads, and other implementation constraints. Further, when the wear member wears out, the entire latch bar needs to be removed for replacement of the latch bar which may incur additional time and efforts.

The latching system also includes a lever pivotally coupled to the dipper door by a pin member and a number of shims. The shims are located proximate to the pin member such that an addition or removal of the shims causes shifting in the entire latching system, which is not desirable. Moreover, in conventional designs, a pull force that is applied to the lever for disengaging the latch bar may bend the lever. Furthermore, current designs of the latch bar and the lever is such that a larger rotation of the lever is required to move the latch bar from the engaged position to the disengaged position.

U.S. Pat. No. 9,890,515 describes a dipper door and a dipper door trip assembly for a mining machine. The dipper door trip assembly includes a trip motor coupled to the boom, a trip drum coupled to the handle, a linkage assembly coupled to the dipper door, a first actuation element extending directly from the trip motor to the trip drum, and a second actuation element extending directly from the trip drum to the linkage assembly. The dipper door trip assembly includes a trip motor, an actuation element coupled to the trip motor, and a linkage assembly coupled to the actuation element. The linkage assembly includes a lever arm coupled to the actuation element, a rod coupled to the lever arm about a first joint, a latch lever bar coupled to the rod about a second joint, and a latch bar coupled to the latch lever bar. The activation of the trip motor causes generally linear movement of the latch bar and latch bar insert.

SUMMARY OF THE DISCLOSURE

In one aspect of the present disclosure, a latching system associated with a dipper door of a dipper is provided. The latching system includes a latch bar that engages with a body of the dipper. The latch bar defines a longitudinal axis centrally passing through the latch bar such that the latch bar is movable along the longitudinal axis. The latch bar includes a housing defining a first end and a second end opposite the first end. The latch bar also includes one or more shims removably coupled to the housing proximate the first end of the housing. The one or more shims allow adjustment of the latch bar along the longitudinal axis. The latch bar further includes a wear member defining a wear surface and a wear axis extending parallel to the wear surface. The wear member is removably coupled to the housing proximate the second end of the housing. An angle defined between the wear axis and the longitudinal axis of the latch bar is less than 45 degrees. The latching system also includes an arm member defining a first end portion and a second end portion. The arm member is pivotally coupled to the dipper door proximate the first end portion such that the arm member is pivotable along a first pivot plane. The arm member contacts a portion of the latch bar for moving the latch bar along the longitudinal axis. The latching system further includes a guide assembly coupled to the arm member. The guide assembly includes a guide pulley coupled to the dipper door and disposed proximate the second end portion of the arm member. The guide assembly also includes an actuation member wound around the guide pulley. One end of the actuation member is coupled to the arm member proximate the second end portion of the arm member such that a pull applied on the actuation member causes the arm member to pivot along the first pivot plane.

In another aspect of the present disclosure, a dipper is provided. The dipper includes a body. The dipper also includes a dipper door pivotally coupled to the body. The dipper further includes a latching system that latches the dipper door with the body. The latching system includes a latch bar that engages with a body of the dipper. The latch bar defines a longitudinal axis centrally passing through the latch bar such that the latch bar is movable along the longitudinal axis. The latch bar includes a housing defining a first end and a second end opposite the first end. The latch bar also includes one or more shims removably coupled to the housing proximate the first end of the housing. The one or more shims allow adjustment of the latch bar along the longitudinal axis. The latch bar further includes a wear member defining a wear surface and a wear axis extending parallel to the wear surface. The wear member is removably coupled to the housing proximate the second end of the housing. An angle defined between the wear axis and the longitudinal axis of the latch bar is less than 45 degrees. The latching system also includes an arm member defining a first end portion and a second end portion. The arm member is pivotally coupled to the dipper door proximate the first end portion such that the arm member is pivotable along a first pivot plane. The arm member contacts a portion of the latch bar for moving the latch bar along the longitudinal axis. The latching system further includes a guide assembly coupled to the arm member. The guide assembly includes a guide pulley coupled to the dipper door and disposed proximate the second end portion of the arm member. The guide assembly also includes an actuation member wound around the guide pulley. One end of the actuation member is coupled to the arm member proximate the second end portion of the arm member such that a pull applied on the actuation member causes the arm member to pivot along the first pivot plane.

In yet another aspect of the present disclosure, a latch bar associated with a dipper is provided. The latch bar defines a longitudinal axis centrally passing through the latch bar such that the latch bar is movable along the longitudinal axis. The latch bar includes a housing defining a first end and a second end opposite the first end. The latch bar also includes one or more shims removably coupled to the housing proximate the first end of the housing. The one or more shims allow adjustment of the latch bar along the longitudinal axis. The latch bar further includes a wear member defining a wear surface and a wear axis extending parallel to the wear surface. The wear member is removably coupled to the housing proximate the second end of the housing. An angle defined between the wear axis and the longitudinal axis of the latch bar is less than 45 degrees.

Other features and aspects of this disclosure will be apparent from the following description and the accompanying drawings.

DETAILED DESCRIPTION

Wherever possible, the same reference numbers will be used throughout the drawings to refer to the same or the like parts. Wherever possible, corresponding or similar reference numbers will be used throughout the drawings to refer to the same or corresponding parts.

Figure 1:
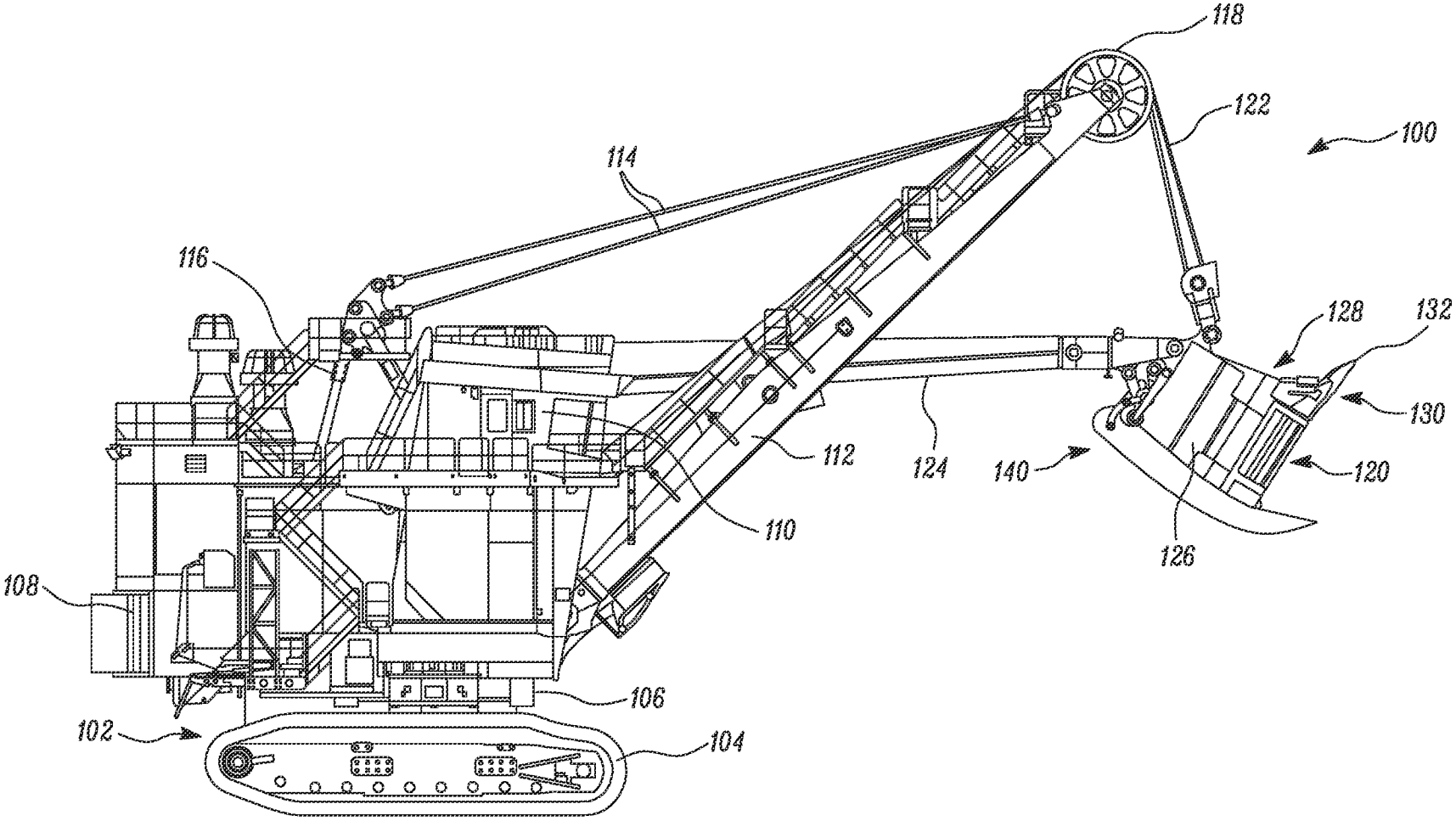
FIG. 1 is a side view of an exemplary machine.

FIG. 1 illustrates an exemplary machine 100. The machine 100 is embodied as a rope shovel herein. Alternatively, the machine 100 may embody another type of machine 100, such as a dragline, or any other machine that is used in mining operations. The machine 100 includes a base 102, a pair of drive tracks 104, a turntable 106, and a revolving frame 108. The base 102 is supported by the drive tracks 104. Further, the base 102 supports the turntable 106 and the revolving frame 108.

The frame 108 supports an engine (not shown) to supply operational power to various components of the machine 100. The engine my include an internal combustion engine. The frame 108 also includes an operator cabin 110. The operator cabin 110 may include a control panel (not shown) to provide inputs for performing one or more operations. The machine 100 also includes a boom 112, a pair of tension cables 114, a gantry member 116, and a sheave 118 rotatably mounted proximate an upper end of the boom 112. The boom 112 is pivotally connected at its lower end to the revolving frame 108. The boom 112 is held in an upwardly and outwardly extending relation to the revolving frame 108 by the tension cables 114.

The machine 100 further includes a dipper 120, a hoist rope 122, a winch drum (not shown), a dipper handle 124, and a transmission unit (not shown). The dipper handle 124 is coupled to the dipper 120. Further, the dipper 120 is suspended from the boom 112 by the hoist rope 122. The hoist rope 122 is wrapped over the sheave 118 and attached to the dipper 120. The hoist rope 122 is anchored to the winch drum. The winch drum may be driven by an electric motor (not shown) or a hydraulic motor (not shown). Bases on a rotation of the winch drum, the hoist rope 122 may lower the dipper 120 or pull the dipper 120 upwards, as per application requirements.

Figure 5:
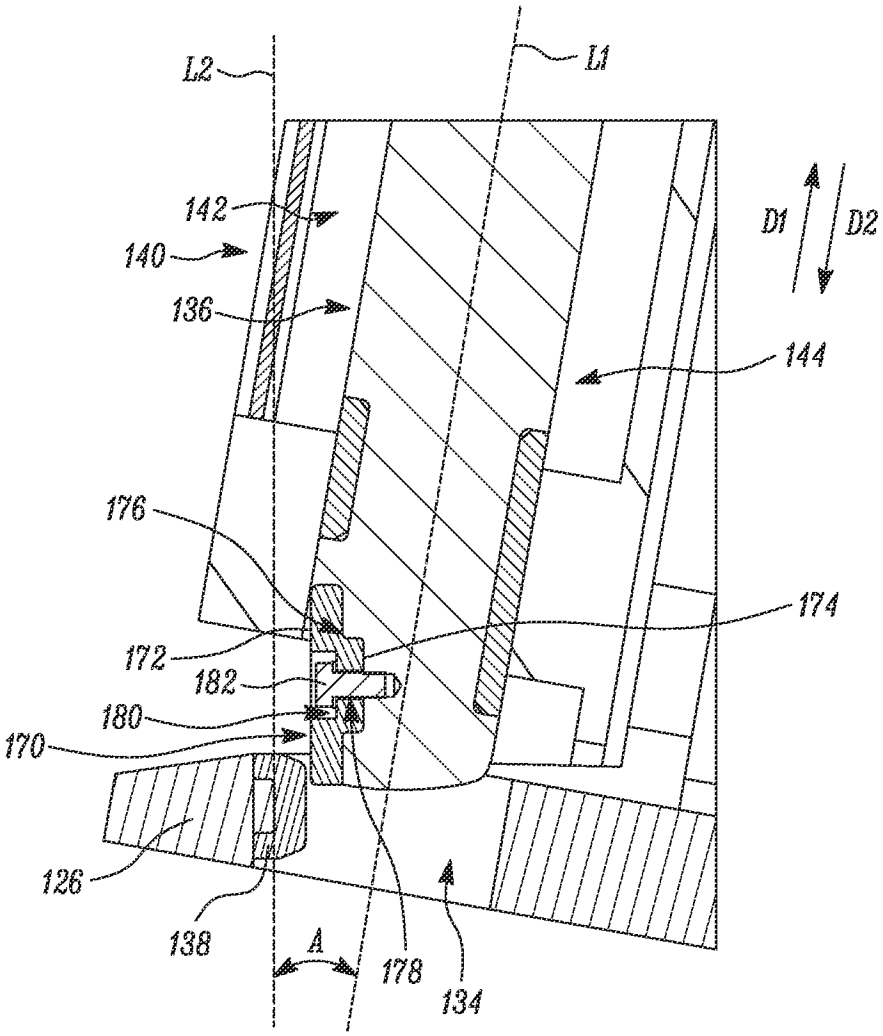
FIG. 5 is a cross-sectional view illustrating the latch bar and a wear member associated with the latch bar of FIG. 2.

The dipper 120 includes a body 126. The body 126 defines a hollow material receiving space 128. A front end 130 of the body 126 includes a number of teeth members 132 that contacts with material during operations, such as digging, to disrupt hard material and avoid wear and tear of the body 126. The body 126 also includes an opening 134 (as shown in FIG. 5) to receive a latch bar 136 (shown in FIG. 2). The opening 134 includes a latch keeper 138 (as shown in FIG. 5). The latch keeper 138 is embodied as a wear member herein.

The dipper 120 also includes a dipper door 140 pivotally coupled to the body 126. The dipper door 140 is latched with the body 126. Further, when material is to be released from the material receiving space 128, the dipper door 140 pivots away from the body 126. The dipper 120 further includes a dipper door trip assembly (not shown). The dipper door trip assembly includes a trip motor. The trip motor is powered by an electrical power source (not shown). The trip motor assists in unlatching the dipper door 140 from the body 126 for allowing the dipper door 140 to pivot away from the dipper 120.

Figure 2:
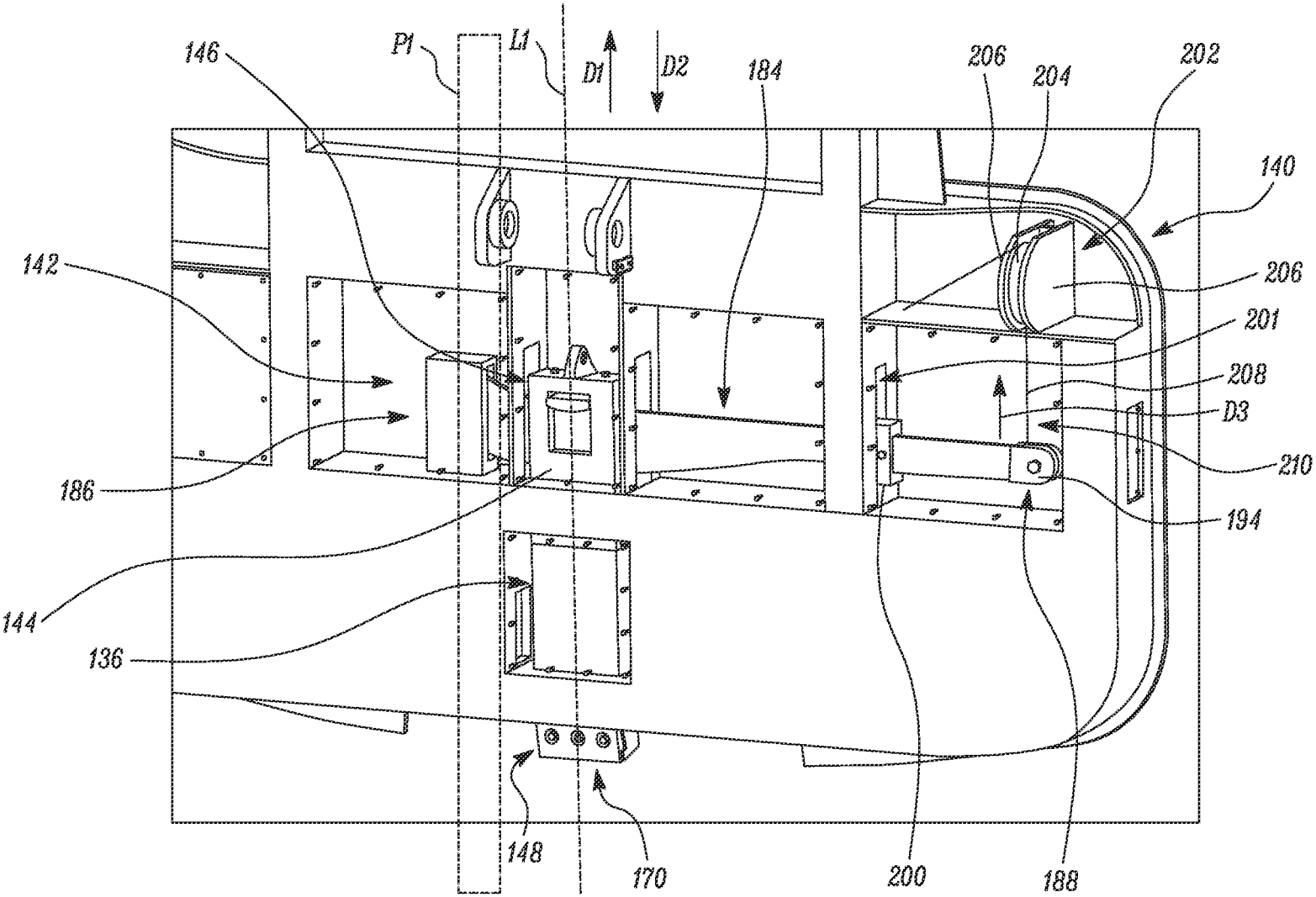
FIG. 2 is a perspective view of a dipper door and a latching system associated with the dipper door, in accordance with the present disclosure.

As shown in FIG. 2, the dipper 120 includes a latching system 142 associated with the dipper door 140 of the dipper 120. The latching system 142 latches the dipper door 140 with the body 126 (see FIG. 1). The latching system 142 includes the latch bar 136 that engages with the body 126 of the dipper 120. The latch bar 136 defines a longitudinal axis "L1" centrally passing through the latch bar 136 such that the latch bar 136 is movable along the longitudinal axis "L1". The latch bar 136 moves along a first direction "D1" for unlatching the dipper door 140 from the body 126. More particularly, the movement of the latch bar 136 along the first direction "D1" disengages the latch bar 136 from the body 126. Further, the latch bar 136 moves along a second direction "D2" for latching the dipper door 140 with the body 126. More particularly, the movement of the latch bar 136 along the second direction "D2" engages the latch bar 136 with the body 126.

The latch bar 136 includes a housing 144 defining a first end 146 and a second end 148 opposite the first end 146. The housing 144 includes a generally rectangular shaped structure. The housing 144 may be manufactured using cast iron or alloy steel. The housing 144 defines a slot 150 (shown in FIGS. 4 and 5) proximate the first end 146.

Figure 3:
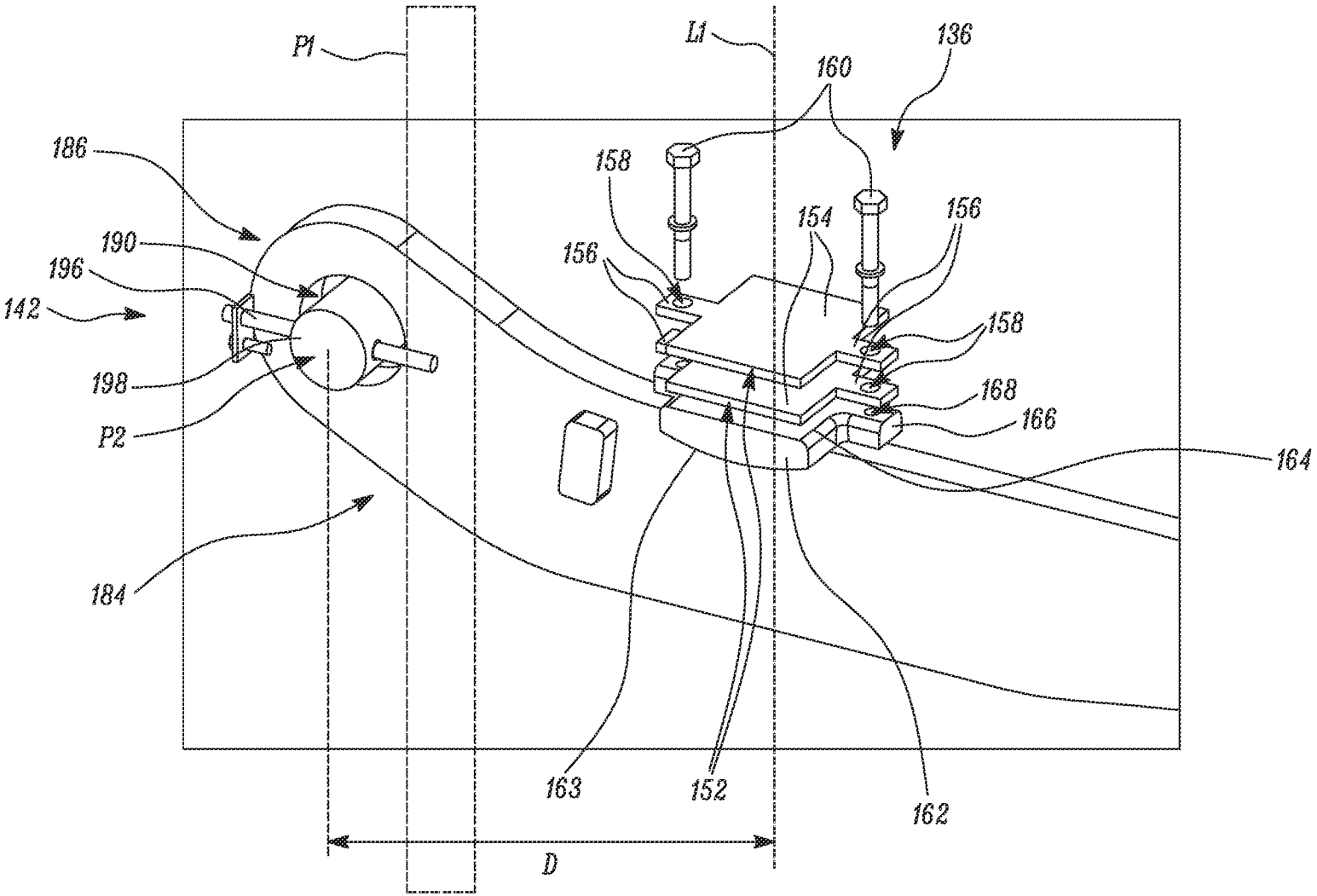
FIG. 3 illustrates a number of shims associated with a latch bar of the latching system of FIG. 2.

FIG. 3 illustrates the latch bar 136 without the housing 144 (see FIG. 2) in order to illustrate a pair of shims 152 and the rocker 162 of the latch bar 136. As shown in FIG. 3, the latch bar 136 includes one or more shims 152 removably coupled to the housing 144 proximate the first end 146 (see FIG. 2) of the housing 144. The one or more shims 152 allow adjustment of the latch bar 136 along the longitudinal axis "L1". Further, the shims 152 may be added or removed to adjust an extent of engagement of the latch bar 136 with the body 126 (see FIG. 1). In the illustrated example, the latch bar 136 includes the pair of shims 152. However, the latch bar 136 may include more than two shims 152 or less than two shims 152, as per application requirements. Each shim 152 includes a first plate member 154 and two first projections 156 disposed at opposite sides of the first plate member 154. The first plate member 154 is generally square in shape. Further, each first projection 156 defines a first through hole 158. The one or more shims 152 are removably coupled to the housing 144 by one or more first mechanical fasteners 160. The first mechanical fastener 160 may include a screw, a bolt, a rivet, and the like.

Further, the latch bar 136 includes a rocker 162 coupled to the housing 144. The rocker 162 is disposed below the shims 152 along the longitudinal axis "L1". The rocker 162 includes a generally square shaped second plate member 164 similar to the shims 152. The rocker 162 also defines a curved contact surface 163. Further the rocker 162 includes two second projections 166. Each second projection 166 defines a second through hole 168. The first through holes 158 in the shims 152, the second through hole 168 in the rocker 162, and a through hole (not shown) in the housing 144 are aligned to receive the first mechanical fastener 160. In the illustrated example, the shims 152 and rocker 162 are removably coupled to the housing 144 using two first mechanical fasteners 160. In other examples, the shims 152 and the rocker 162 may be removably coupled to the housing 144 using any number of the first mechanical fasteners 160.

Figure 4:
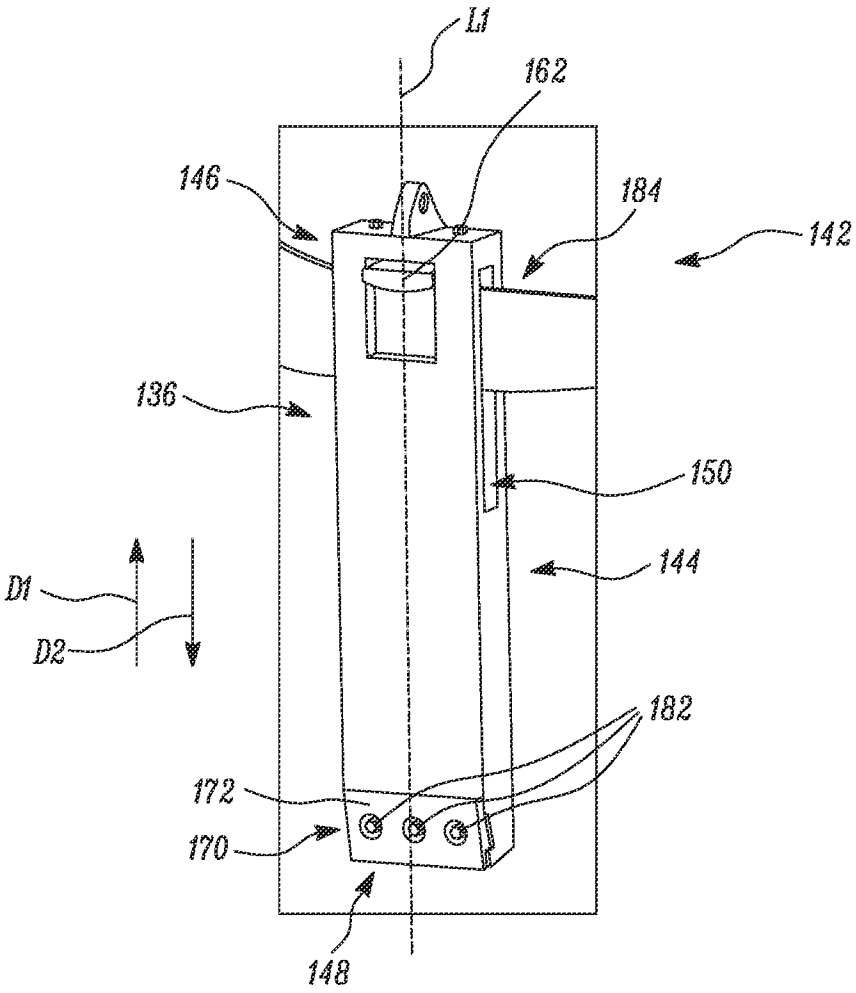
FIG. 4 is a perspective view of the latch bar of FIG. 2.

Referring to FIG. 4, the latch bar 136 includes a wear member 170 defining a wear surface 172 and a wear axis "L2" (shown in FIG. 5) extending parallel to the wear surface 172. The wear member 170 also includes a rear surface 174 (shown in FIG. 5) opposite the wear surface 172 and generally parallel to the wear surface 172. The wear member 170 is removably coupled to the housing 144 proximate the second end 148 of the housing 144. The wear member 170 is received within a cavity 176 (shown in FIG. 5) defined in the housing 144.

The wear member 170 includes a stepped design herein. Further, the wear member 170 is embodied as a generally rectangular shaped structure. As illustrated in FIG. 5, the wear member 170 defines a number of first openings 178 and a corresponding number of counterbores 180. In the illustrated example, the wear member 170 defines three first openings 178 and three counterbores 180. In other examples, the wear member 170 may define any number of the first openings 178 and the counterbores 180, without limiting the scope of the present disclosure. The wear member 170 may be manufactured using a material such as alloy steels and the like. The wear member 170 is removably coupled to the housing 144 by one or more second mechanical fasteners 182. The second mechanical fasteners 182 may include a screw, a bolt, a rivet, and the like. In the illustrated example, the wear member 170 is removably coupled to the housing 144 by three second mechanical fasteners 182. As illustrated, head portions of the second mechanical fasteners 182 are received within the counterbores 180.

Further, the wear surface 172 of the wear member 170 is inclined relative to the longitudinal axis "L1". More particularly, an angle "A" is defined between the wear axis "L2" and the longitudinal axis "L1". In the illustrated example, the angle "A" defined between the wear axis "L2" and the longitudinal axis "L1" of the latch bar 136 is less than 45 degrees. In an example, the angle "A" defined between the wear axis "L2" and the longitudinal axis "L1" lies in a range of 5 degrees and 20 degrees. In one specific example, the angle "A" between the wear axis "L2" and the longitudinal axis "L1" may be between 7 degrees and 12 degrees.

In the illustrated example, the cavity 176 in the housing 144 is provided such that the wear surface 172 is angularly disposed relative to the longitudinal axis "L1" when the wear member 170 is received within the cavity 176. In another example, the wear surface 172 may be inclined relative to the rear surface 174 such that the wear surface 172 is angularly disposed relative to the longitudinal axis "L1" when the wear member 170 is received within the cavity 176. In such examples, the inclined wear surface 172 may be provided by machining or any other material removal process. It should be noted that the present disclosure is not limited to a technique that is used to define the angle "A" between the wear axis "L2" and the longitudinal axis "L1".

In an engaged position of the latch bar 136, the wear member 170 contacts the latch keeper 138. Further, when the latch bar 136 moves from the engaged position to a disengaged position, the latch bar 136 moves along the first direction "D1" such that the latch bar 136 is pulled away from the latch keeper 138. The movement of the latch bar 136 is inclined to a plane of contact of the wear member 170 and the latch keeper 138. Thus, the wear member 170 does not slide over a surface of the latch keeper 138 when the latch bar 136 moves from the engaged position to the disengaged position.

Figure 6:
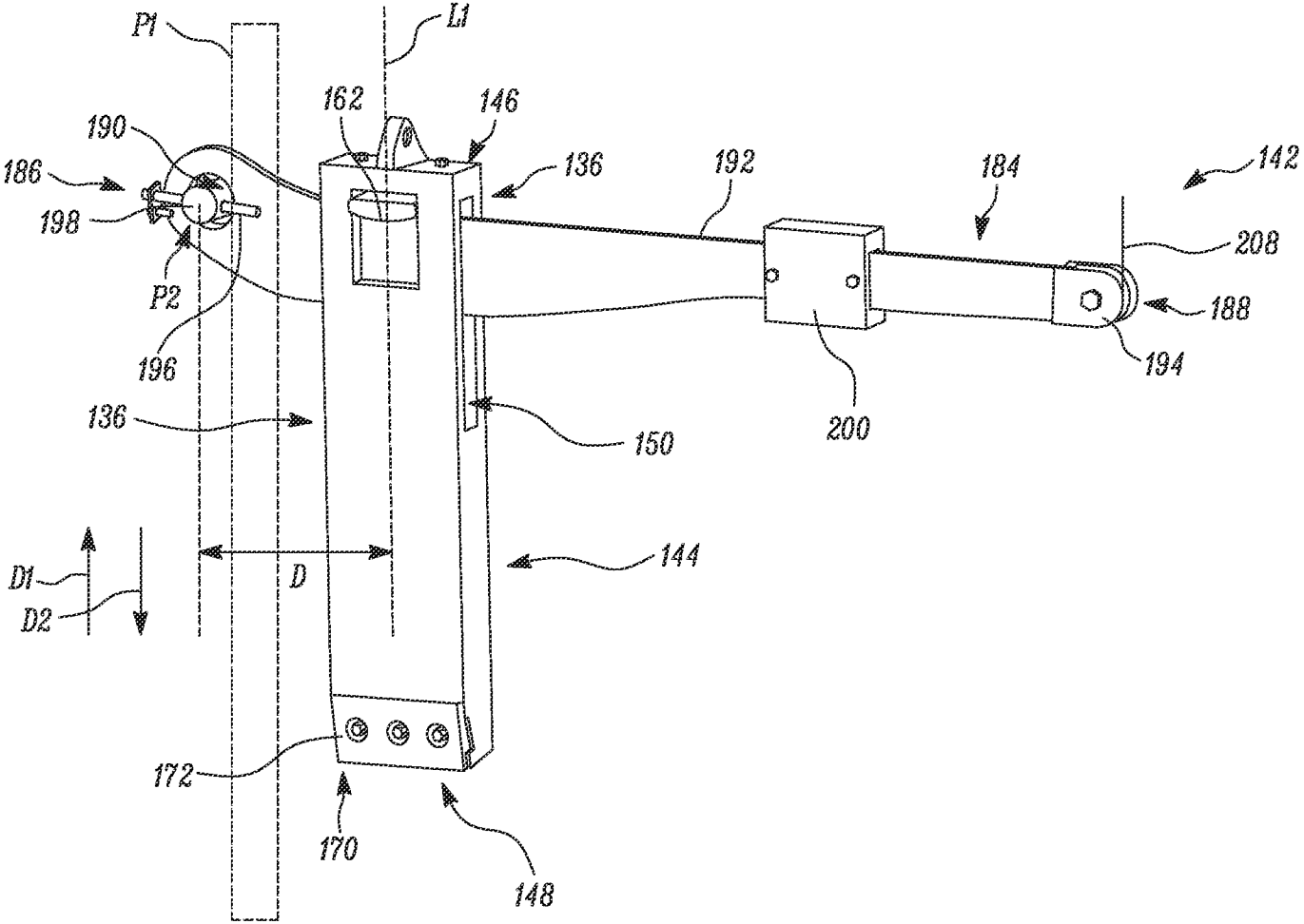
FIG. 6 is a perspective view of the latching system of FIG. 2.

As shown in FIG. 6, the latching system 142 also includes an arm member 184 defining a first end portion 186 and a second end portion 188. The arm member 184 includes an elongated structure. The arm member 184 defines a circular opening 190 proximate the first end portion 186. Further, the arm member 184 defines a top surface 192. Moreover, the arm member 184 includes a circular bracket 194 disposed proximate the second end portion 188.

The arm member 184 is pivotally coupled to the dipper door 140 proximate the first end portion 186 such that the arm member 184 is pivotable along a first pivot plane "P1". The arm member 184 may pivot along the first pivot plane "P1" to move the latch bar 136 longitudinally along the longitudinal axis "L1". The arm member 184 is pivotally coupled to the dipper door 140 at a first pivot point "P2", such that a distance "D" between the first pivot point "P2" and the longitudinal axis "L1" of the latch bar 136 lies in a range of 300 mm and 1000 mm. In an example, the distance "D" lies approximately in a range of 500 mm and 600 mm.

The arm member 184 is pivotally coupled to the dipper door 140 by a pivot pin 196 and a coupling member 198. The coupling member 198 is fixedly coupled to the dipper door 140 (see FIG. 2). Further, the coupling member 198 receives the circular opening 190 defined in the arm member 184. Moreover, the coupling member 198 defines a through hole (not shown) that receives the pivot pin 196. A coupling of the pivot pin 196 with the coupling member 198 allows the pivotable coupling of the arm member 184. In some examples, a centerline of the pivot pin 196 is in the same plane as the top surface 192 of the arm member 184.

As illustrated, the slot 150 of the housing 144 receives some portion of the arm member 184. Further, the arm member 184 contacts a portion of the latch bar 136 for moving the latch bar 136 along the longitudinal axis "L1". More particularly, the arm member 184 contacts the rocker 162 for moving the latch bar 136 along the longitudinal axis "L1". The top surface 192 of the arm member 184 contacts with the curved contact surface 163 (see FIG. 3) of the rocker 162 as the arm member 184 pivots along the first pivot plane "P1".

Referring now to FIG. 2, the arm member 184 also includes a bumper 200 that is disposed proximate the second end portion 188 of the arm member 184. The bumper 200 slides in a slot 201 defined in the dipper door 140. The bumper 200 may be fastened to the arm member 184 using mechanical fasteners, such as screws, bolts, rivets, and the like.

The latching system 142 includes a guide assembly 202 coupled to the arm member 184. The guide assembly 202 includes a guide pulley 204 coupled to the dipper door 140 and disposed proximate the second end portion 188 of the arm member 184. The guide pulley 204 may be mounted to the dipper door 140 by a pair of brackets 206. The pair of brackets 206 are fixedly coupled to the dipper door 140.

The guide assembly 202 also includes an actuation member 208 wound around the guide pulley 204. The actuation member 208 includes a rope, a chain, or a belt. In the illustrated example, the actuation member 208 is a rope. One end 210 of the actuation member 208 is coupled to the arm member 184 proximate the second end portion 188 of the arm member 184 such that a pull applied on the actuation member 208 causes the arm member 184 to pivot along the first pivot plane "P1". Specifically, the actuation member 208 is coupled to the circular bracket 194 of the arm member 184. Further, another end of the actuation member 208 may be coupled to the trip motor.

Based on an input provided to the trip motor, the trip motor may cause pulling of the actuation member 208. Further, the actuation member 208 is pulled along a pull direction "D3", such that the pull direction "D3" coincides with the first pivot plane "P1". As the actuation member 208 is pulled, the arm member 184 pivots along the first pivot plane "P1". The pivoting of the arm member 184 causes the latch bar 136 to move in the first direction "D1" along the longitudinal axis "L1" based on contact between the arm member 184 and the rocker 162 (see FIG. 3). A continual movement of the latch bar 136 disengages the latch bar 136 from the body 126, thereby allowing the dipper door 140 to pivot relative to the body 126 of the dipper 120.

INDUSTRIAL APPLICABILITY

The present disclosure relates to the latching system 142 associated with the dipper door 140 of the dipper 120. The latch bar 136 of the latching system 142 includes the wear member 170. The wear surface 172 of the wear member 170 is inclined relative to the longitudinal axis "L1". This feature minimizes generation of high point stresses and wear due to friction between the wear member 170 and the latch keeper 138, thereby increasing an operating life of the wear member 170. Further, the angle "A" between the wear axis "L2" and the longitudinal axis "L1" of the latch bar 136 restricts the sliding of the wear member 170 over the latch keeper 138. Further, the wear member 170 can be easily coupled or removed from the latch bar 136 during a replacement of the wear member 170 without removal of the latch bar 136.

The distance "D" between the first pivot point "P2" and the longitudinal axis "L1" of the latch bar 136 is optimally decided to ensure minimum lateral shift of the latch bar 136 along the top surface 192 of the arm member 184. Further, the distance between the first pivot point "P2" and the longitudinal axis "L1" of the latch bar 136 is selected such that the latch bar 136 disengages from the body 126 with minimal rotation about the first pivot point "P2".

The latch bar 136 includes the number of shims 152 that are positioned within the housing 144 of the latch bar 136. The shims 152 can be added or removed to adjust the engagement of the latch bar 136 alone, while restricting the shifting of other components of the latching system 142, such as the arm member 184. Moreover, the pull direction "D3" of the actuation member 208 coincides with the first pivot plane "P1", which allows for a full utilization of a pull force regardless of a pull angle. This feature eliminates bending of the arm member 184.

While aspects of the present disclosure have been particularly shown and described with reference to the embodiments above, it will be understood by those skilled in the art that various additional embodiments may be contemplated by the modification of the disclosed machine 100*s*, systems and methods without departing from the spirit and scope of what is disclosed. Such embodiments should be understood to fall within the scope of the present disclosure as determined base 102*d* upon the claims and any equivalents thereof

What is claimed is:

1. A latching system associated with a dipper door of a dipper, the latching system comprising:

a latch bar that engages with a body of the dipper, the latch bar defining a longitudinal axis centrally passing through the latch bar such that the latch bar is movable along the longitudinal axis, the latch bar including:

a housing defining a first end and a second end opposite the first end;

one or more shims removably coupled to the housing proximate the first end of the housing, wherein the one or more shims allow adjustment of the latch bar along the longitudinal axis; and a wear member defining a wear surface and a wear axis extending parallel to the wear surface, wherein the wear member is removably coupled to the housing proximate the second end of the housing;

an arm defining a first end portion and a second end portion, the arm being pivotally coupled to the dipper door proximate the first end portion such that the arm is pivotable along a first pivot plane, wherein the arm contacts a portion of the latch bar to move the latch bar along the longitudinal axis; and a guide assembly coupled to the arm, wherein the guide assembly includes:

a guide pulley coupled to the dipper door and disposed proximate the second end portion of the arm; and an actuator wound around the guide pulley, wherein one end of the actuator is coupled to the arm proximate the second end portion of the arm such that a pull applied on the actuator causes the arm to pivot along the first pivot plane, wherein an angle of incline defined between the wear axis and the longitudinal axis of the latch bar is in a range of 5 degrees and 45 degrees, inclusive, and is to restrict sliding of the wear member over a latch keeper of the latching system.

2. The latching system of claim 1, wherein the arm is pivotally coupled to the dipper door at a first pivot point, such that a distance between the first pivot point and the longitudinal axis of the latch bar lies in a range of 300 mm and 1000 mm inclusive.

3. The latching system of claim 1, wherein the one or more shims are removably coupled to the housing by one or more first mechanical fasteners.

4. The latching system of claim 1, wherein the wear member is removable from the latch bar without removal of the latch bar from the latching system.

5. The latching system of claim 1, wherein the latch bar includes a rocker coupled to the housing, such that the arm contacts the rocker to move the latch bar along the longitudinal axis.

6. The latching system of claim 1, wherein the wear member is removably coupled to the housing by one or more second mechanical fasteners.

7. The latching system of claim 1, wherein the actuator is adapted to be pulled along a pull direction, such that the pull direction coincides with the first pivot plane.

8. The latching system of claim 1, wherein the actuator includes at least one of a rope, a chain, and a belt.

9. A dipper comprising:

a body;

a dipper door pivotally coupled to the body; and a latching system that latches the dipper door with the body, the latching system including:

a latch bar that engages with the body of the dipper, the latch bar defining a longitudinal axis centrally passing through the latch bar such that the latch bar is movable along the longitudinal axis, the latch bar including:

a housing defining a first end and a second end opposite the first end;

one or more shims removably coupled to the housing proximate the first end of the housing, wherein the one or more shims allow adjustment of the latch bar along the longitudinal axis; and a wear member defining a wear surface and a wear axis extending parallel to the wear surface, wherein the wear member is removably coupled to the housing proximate the second end of the housing;

an arm defining a first end portion and a second end portion, the arm being pivotally coupled to the dipper door proximate the first end portion such that the arm is pivotable along a first pivot plane, wherein the arm contacts a portion of the latch bar to move the latch bar along the longitudinal axis; and a guide assembly coupled to the arm, wherein the guide assembly includes:

a guide pulley coupled to the dipper door and disposed proximate the second end portion of the arm; and an actuator wound around the guide pulley, wherein one end of the actuator is coupled to the arm proximate the second end portion of the arm such that a pull applied on the actuator causes the arm to pivot along the first pivot plane, wherein an angle of incline defined between the wear axis and the longitudinal axis of the latch bar is in a range of 5 degrees and 45 degrees, inclusive, and is to restrict sliding of the wear member over a latch keeper of the dipper.

10. The dipper of claim 9, wherein the arm is pivotally coupled to the dipper door at a first pivot point, such that a distance between the first pivot point and the longitudinal axis of the latch bar lies in a range of 300 mm and 1000 mm inclusive.

11. The dipper of claim 9, wherein the one or more shims are removably coupled to the housing by one or more first mechanical fasteners.

12. The dipper of claim 9, wherein the wear member is removable from the latch bar without removal of the latch bar from the latch bar.

13. The dipper of claim 9, wherein the latch bar includes a rocker coupled to the housing, such that the arm contacts the rocker to move the latch bar along the longitudinal axis.

14. The dipper of claim 9, wherein the wear member is removably coupled to the housing by one or more second mechanical fasteners.

15. The dipper of claim 9, wherein the actuator is adapted to be pulled along a pull direction, such that the pull direction coincides with the first pivot plane.

16. A latch bar associated with a dipper, the latch bar defining a longitudinal axis centrally passing through the latch bar such that the latch bar is movable along the longitudinal axis, the latch bar including:

a housing defining a first end and a second end opposite the first end;

one or more shims removably coupled to the housing proximate the first end of the housing, wherein the one or more shims allow adjustment of the latch bar along the longitudinal axis; and a wear member defining a wear surface and a wear axis extending parallel to the wear surface, wherein the wear member is removably coupled to the housing proximate the second end of the housing, and wherein an angle of incline defined between the wear axis and the longitudinal axis of the latch bar is in a range of 5 degrees and 45 degrees, inclusive, and is to restrict sliding of the wear member over a latch keeper associated with the latch bar.

17. The latch bar of claim 16, wherein the one or more shims are removably coupled to the housing by one or more first mechanical fasteners.

18. The latch bar of claim 16, wherein the wear member is removable from the latch bar without removal of the latch bar from the latch bar.

19. The latch bar of claim 16, wherein the latch bar includes a rocker coupled to the housing.

20. The latch bar of claim 16, wherein the wear member is removably coupled to the housing by one or more second mechanical fasteners.

* * * * *